US008416182B2

(12) United States Patent
Hong et al.

(10) Patent No.: US 8,416,182 B2
(45) Date of Patent: Apr. 9, 2013

(54) APPARATUS AND METHOD FOR DRIVING A LIQUID CRYSTAL DISPLAY DEVICE FOR REDUCING RIPPLE NOISE

(75) Inventors: Jin-Woo Hong, Paju-si (KR); Dae-Heung Lee, Euiwang-si (KR); Seung-Hyun Kim, Seoul (KR); Byung-Sam Min, Yangju-si (KR); Hyun-Woo Jeon, Gumi-Si (KR)

(73) Assignee: LG Display Co. Ltd., Seoul (KR)

( * ) Notice: Subject to any disclaimer, the term of this patent is extended or adjusted under 35 U.S.C. 154(b) by 304 days.

(21) Appl. No.: 12/481,877

(22) Filed: Jun. 10, 2009

(65) Prior Publication Data

US 2010/0156946 A1 Jun. 24, 2010

(30) Foreign Application Priority Data

Dec. 18, 2008 (KR) ..... 10-2008-129176

(51) Int. Cl.
*G09G 3/36* (2006.01)

(52) U.S. Cl. ..... 345/102; 345/99

(58) Field of Classification Search ..... 345/87, 345/99, 102, 690–691
See application file for complete search history.

(56) References Cited

U.S. PATENT DOCUMENTS

2003/0193459 A1* 10/2003 Kim et al. ..... 345/87
2006/0038810 A1* 2/2006 Ebata et al. ..... 345/213
2008/0198183 A1* 8/2008 Min et al. ..... 345/691

* cited by examiner

*Primary Examiner* — Chanh Nguyen
*Assistant Examiner* — Jonathan Blancha
(74) *Attorney, Agent, or Firm* — Brinks Hofer Gilson & Lione

(57) ABSTRACT

An apparatus and method for driving a liquid crystal display (LCD) device is disclosed. The apparatus for driving a liquid crystal display (LCD) device includes a liquid crystal display (LCD) panel for receiving a video signal and a clock signal, and displaying them, a backlight for emitting light on the LCD panel, a timing controller for controlling the LCD panel and the backlight, a signal generator which has the same frequency as that of a horizontal synchronous signal by modulating the clock signal, and generates a signal synchronized with the horizontal synchronous signal, and an inverter which receives a signal from the signal generator, allows a driving frequency of the light source to be the same as that of the horizontal synchronous signal, and allows the received signal to be synchronized with the horizontal synchronous signal.

4 Claims, 2 Drawing Sheets

APPARATUS AND METHOD FOR DRIVING A LIQUID CRYSTAL DISPLAY DEVICE FOR REDUCING RIPPLE NOISE

RELATED APPLICATIONS

This application claims the benefit of Korean Patent Application No. 10-2008-0129176, filed on Dec. 18, 2008, which is hereby incorporated by reference as if fully set forth herein.

BACKGROUND

1. Field of the Disclosure

The present disclosure relates to an apparatus and method for driving a liquid crystal display (LCD) device, and more particularly to an apparatus and method for driving a liquid crystal display (LCD) device so as to prevent ripple noise from being generated.

2. Discussion of the Related Art

Thin-and-light flat panel displays (FPDs) have been widely used throughout the world. Specifically, a liquid crystal display (LCD) device has a low operation voltage, so that it only consumes a small amount of power consumption and can be easily carried by a user. As a result, the LCD device is available for a variety of application fields, for example, computers, monitors, spacecrafts, airplanes, etc.

Generally, the LCD device does not emit light by itself, such that another light generated from an additional light source is incident to the LCD device, resulting in the formation of an image. This light source is driven by an inverter.

In this case, the inverter converts a low DC voltage to a pulse width modulation (PWM) signal having a predetermined frequency. This PWM signal is converted into a high-frequency light source voltage capable of driving the light source using a transformer.

FIG. 1 is a block diagram illustrating a conventional apparatus for driving a liquid crystal display (LCD) device.

Referring to FIG. 1, the conventional apparatus for driving the LCD device includes a liquid crystal display (LCD) panel 1 including matrix-type pixel areas formed by orthogonal arrangement between data lines (D) and gate lines (G), a driving circuit 2 for providing the LCD panel 1 with a driving signal and a data signal, and a backlight 8 for providing the LCD panel 1 with a constant light source.

In this case, the driving circuit 2 includes a gate driver 1*a*, a data driver 1*b*, a timing controller 3, a power-supply unit 4, and an inverter 9. The gate driver 1*a* transmits a gate driving pulse to each gate line of the LCD panel 1. The data driver 1*b* transmits the data signal to each data line of the LCD panel 1. The timing controller 3 receives not only video data (R,G,B) but also control signals (DTEN) (e.g., vertical and horizontal synchronous signals (Vsync and Hsync), and a clock signal (DCLK)) from the driving system 7 of the LCD panel 1. The timing controller 3 formats each display data and the clock and control signals at a timing point where each data driver 1*b* and each gate driver 1*a* of the LCD panel 1 can appropriately reproduce data on the screen. The power-supply unit 4 provides individual components of the LCD panel 1 with a necessary voltage. The inverter 9 drives the backlight 8.

Operations of the conventional apparatus for driving the LCD device will hereinafter be described. In more detail, the timing controller 3 receives display data (R,G,B) and control signals (DTEN) (e.g., the vertical and horizontal synchronous signals (Vsync and Hsync) and the clock signal (DCLK)) from the driving system 7 of the LCD panel 1, provides each display data and the clock and control signals at a timing point where each data driver 1*b* and each gate driver 1*a* of the LCD panel 1 can appropriately reproduce data on the screen. The gate driver 1*a* transmits a gate driving pulse to each gate line of the LCD panel 1. The data driver 1*b* is synchronized with the gate driving pulse such that it outputs the data signal to each data line of the LCD panel 1, resulting in the display of input video signals.

In this case, the backlight 8 may generate ripple noise among video noise signals caused by interference between the output voltage frequency and the horizontal synchronous signal (Hsync) of the inverter 9.

SUMMARY

An apparatus for driving a liquid crystal display (LCD) device includes: a liquid crystal display (LCD) panel for receiving a video signal and a clock signal, and displaying them; a backlight for emitting light on the LCD panel; a timing controller for controlling the LCD panel and the backlight; a signal generator which has the same frequency as that of a horizontal synchronous signal by modulating the clock signal, and generates a signal synchronized with the horizontal synchronous signal; and an inverter which receives a signal from the signal generator, allows a driving frequency of the light source to be the same as that of the horizontal synchronous signal, and allows the received signal to be synchronized with the horizontal synchronous signal.

In another aspect, there is provided a method for driving a liquid crystal display (LCD) device including a timing controller, which receives video signals and various control signals and drives a liquid crystal display (LCD) panel using the received signals, the method comprising: receiving a clock signal among the control signals applied to the timing controller, modulating the received clock signal, allowing the modulated resultant signal to have the same frequency as that of a horizontal synchronous signal, and generating a signal synchronized with the horizontal synchronous signal; and allowing an inverter output frequency to have the same frequency as that of the horizontal synchronous signal by the modulated signal, allowing the resultant signal to be synchronized with the horizontal synchronous signal, and driving a light source using the synchronized signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawing.

DETAILED DESCRIPTION OF THE EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
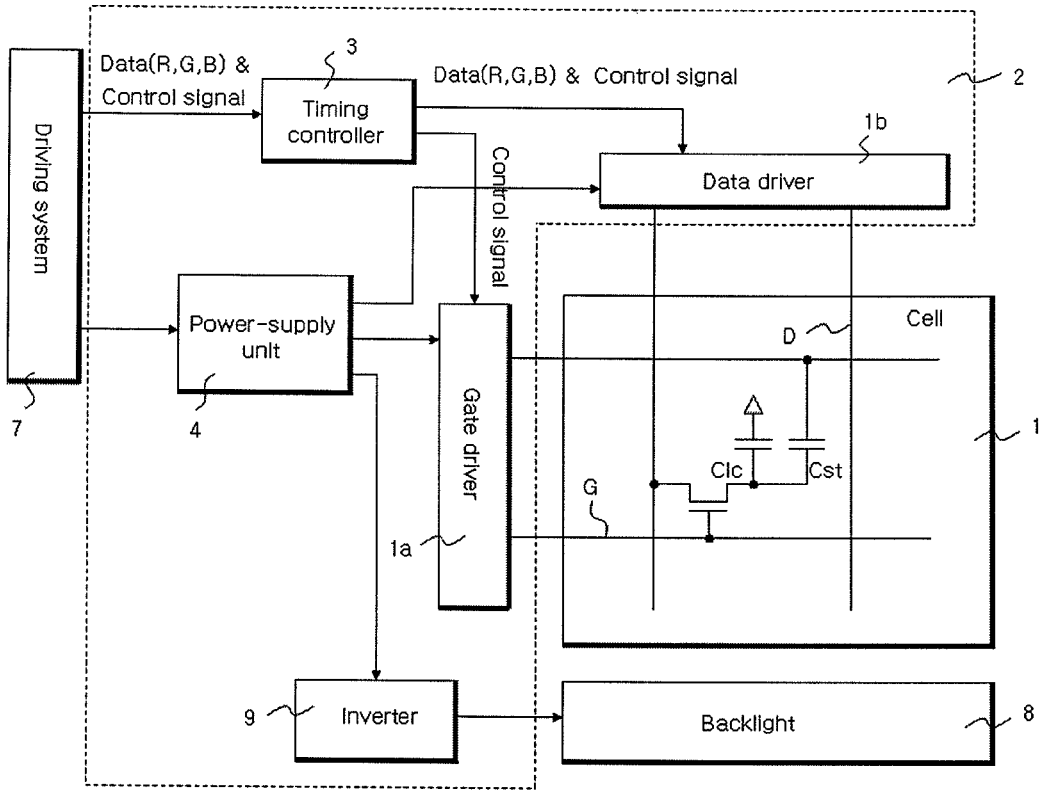
FIG.1 Related Art
FIG. 1 is a block diagram illustrating a conventional apparatus for driving a liquid crystal display (LCD) device.
Figure 2:
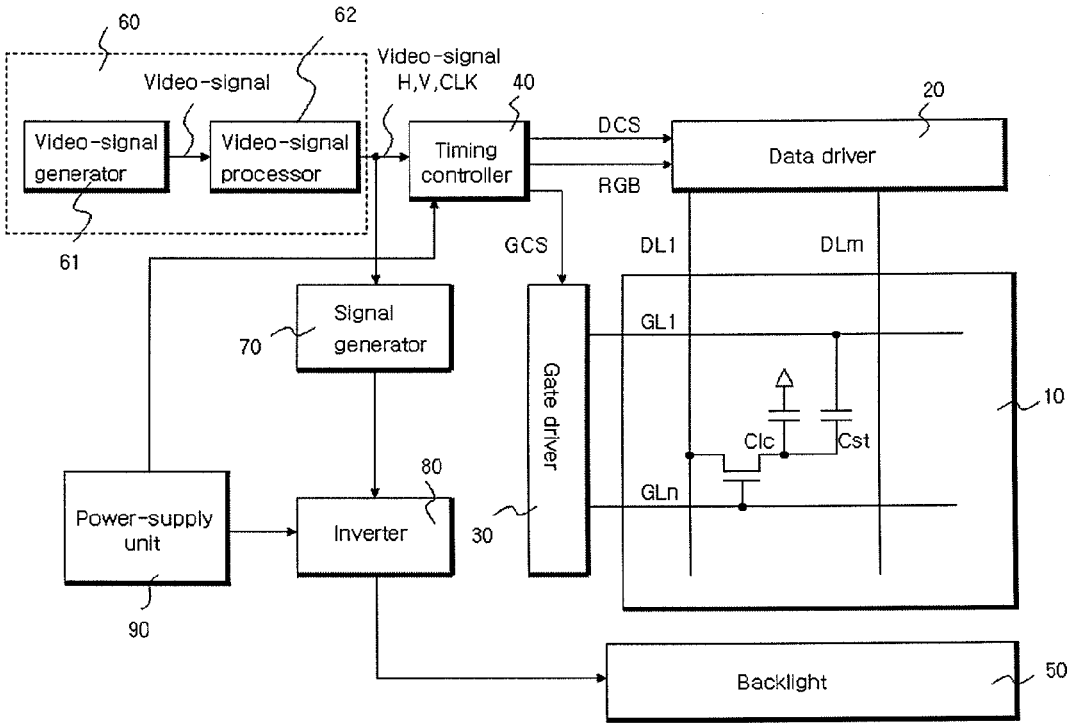
FIG. 2 is a block diagram illustrating an apparatus for driving a liquid crystal display (LCD) device according to an embodiment of the present invention.

FIG. 2 is a block diagram illustrating an apparatus for driving a liquid crystal display (LCD) device according to AN embodiment of the present invention.

Referring to FIG. 2, the conventional apparatus for driving the LCD device includes a liquid crystal display (LCD) panel 10, a data driver 20, a gate driver 30, a timing controller 40, a backlight 50, a driving system 60, a signal generator 70, and an inverter 80. The LCD panel 10 includes matrix-type pixel areas formed by orthogonal arrangement between data lines (DL) and gate lines (GL). The data driver 20 transmits the data voltage to each data line (DL) of the LCD panel 10. The gate driver 30 sequentially drives the gate lines (GL) of the LCD panel 10. The timing controller 40 controls the data driver 20 and the gate driver 30. The backlight 50 emits light on the LCD panel 10. The driving system 60 outputs a video signal from an external part, the vertical and horizontal synchronous signals (Vsync and Hsync) and the clock signal (DCLK) to the timing controller 40. The generator 70 receives the clock signal (DCLK) applied to the timing controller 40, and modulates the received clock signal (DLCK), such that it generates a synchronous signal having the same frequency as that of the horizontal synchronous signal (Hsync). The inverter 80 receives the signal generated from the signal generator 70, and drives a driving frequency of the backlight 50 at a frequency synchronized with the horizontal synchronous signal (Hsync).

A video signal processor 62 of the driving system 60 performs a scaling according to the size of the LCD panel 10, and outputs the video and synchronous signals generated from a video-signal generator 61 to the timing controller 40.

Also, the clock signal (DCLK) generated from the video-signal processor 62 is applied to each of the timing controller 40 and the signal generator 70.

Although the present invention discloses the signal generator 70 and the timing controller 40 which are constructed separately from each other as an example, the scope of the present invention is not limited to only this example, but the signal generator 70 may also be embedded in the timing controller 40 as necessary.

The timing controller 40 arranges video signals (R,G,B) generated from the video-signal processor 62 of the driving system 60 according to the driving of the LCD panel 10, and outputs the arranged video signals to the data driver 20.

The timing controller 40 generates the gate control signal (GCS) and the data control signal (DCS) using the synchronous signals (CLK, Hsync, and Vsync) received from the video-signal processor 62, and controls the data driver 20 and the gate driver 30.

The data driver 20, in response to the data control signals (DCS) from the timing controller 40, transmits a data signal of one line to the data control lines (DL1~DLm) at each horizontal period (H1, H2 . . . ).

Specifically, the data driver 20 converts digital video data (R,G,B) received from the timing controller 40 into an analog data voltage, and outputs the analog data voltage to the data line (DL).

The gate driver 30, in response to the gate control signals (GCS) from the timing controller 40, sequentially transmits the gate signal to the gate lines (GL1~GLn), By this gate signal, thin film transistors (TFTs) connected to the gate lines (GL1~GLn) are driven in the individual gate lines (GL) independent of each other.

The LCD panel 10 displays video signals according to the control and data signals provided from the timing controller 40 to the data driver 20 and the gate driver 30.

The LCD panel 10 includes gate lines (GL1~GLn), data lines (DL1~DLm) crossed with the gate lines (GL1~GLn), TFTs, each of which is formed in each pixel area formed by each crossing of the gate lines (GL1~GLn) and the data lines (DL1~DLm), and includes a liquid crystal cell (Clc) connected to each TFT.

The backlight 50 is installed at a backside of the LCD panel 10, and emits light on the LCD panel 10.

The signal generator 70 modulates the clock signal generated from the video-signal processor 62 so that the modulated signal has the same frequency as that of the horizontal synchronous signal. The signal generator 70 generates the signal synchronized with the horizontal synchronous signal, and the signal generated from the signal generator 70 is applied to the inverter 80, such that it controls the driving frequency of the backlight 50.

The above-mentioned apparatus for driving the LCD device allows the signal generator 70 to generate a signal by which the backlight 50 driven by the inverter 80 can be synchronized with the horizontal synchronous signal (Hsync) serving as one of frequency signals applied to the timing controller 40, and drives the backlight 50 using the generated signal, such that it can solve the problem of ripple noise serving as one of video noises.

As apparent from the above-mentioned description, the apparatus and method for driving the LCD device according to the disclosed embodiments of the present invention have the following effects.

The disclosed embodiments of the present invention establishe synchronization between a horizontal synchronous signal and an inverter driving frequency among various video signals applied to the timing controller, such that it can remove ripple noise serving as one of video noise signals caused by interference between the horizontal synchronous signal and the inverter driving frequency signal.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. An apparatus for driving a liquid crystal display (LCD) device comprising:

a liquid crystal display (LCD) panel that receives video signals, and displaying an image corresponding to the video signals;

a backlight for emitting light on the LCD panel;

a timing controller that controls the LCD panel and the backlight;

a driving system outputs a clock signal from an external part, a vertical and horizontal synchronous signals to the timing controller;

a signal generator which receives the clock signal and the horizontal signal applied to the timing controller, and modulates the received clock signal such that said signal generator generates a signal synchronized with the horizontal synchronous signal and which has the same frequency as that of the horizontal synchronous signal; and an inverter which receives said signal from the signal generator, allows a driving frequency of the backlight to be the same as that of the horizontal synchronous signal, and allows the received signal to be synchronized with the horizontal synchronous signal.

2. The apparatus according to claim 1, wherein the signal generator is embedded in the timing controller.

3. The apparatus according to claim 1, wherein the signal generator is constructed separately from the timing controller.

4. A method for driving a liquid crystal display (LCD) device including a timing controller, which receives video signals and various control signals and drives a liquid crystal display (LCD) panel using the received signals, the method comprising:

supplying a clock signal from a driving system, and a vertical and horizontal synchronous signals to the timing controller, receiving the clock signal and the horizontal synchronous signal applied to the timing controller, modulating the received clock signal, allowing the modulated clock signal to be synchronized with the horizontal synchronous signal, and generating a signal synchronized with the horizontal synchronous signal; and allowing an inverter output frequency to have the same frequency as that of the horizontal synchronous signal by the modulated signal, allowing the inverter output signal to be synchronized with the horizontal synchronous signal, and driving a light source using the synchronized inverter output signal.

* * * * *